US006378135B1

(12) United States Patent
Hemming et al.

(10) Patent No.: US 6,378,135 B1
(45) Date of Patent: Apr. 30, 2002

(54) NURSING GARMENT

(75) Inventors: Valda K. Hemming, Mesa, AZ (US); Tony Lazzaro, East Patchogue, NY (US)

(73) Assignee: Pretty Private LLC, Mesa, AZ (US)

( * ) Notice: Subject to any disclaimer, the term of this patent is extended or adjusted under 35 U.S.C. 154(b) by 0 days.

(21) Appl. No.: 09/742,031

(22) Filed: Dec. 20, 2000

(51) Int. Cl.[7] ..... A41D 1/20
(52) U.S. Cl. ..... 2/104; 2/46
(58) Field of Search ..... 2/104, 46, 48, 2/49.1, 50–52, 91

(56) References Cited

U.S. PATENT DOCUMENTS 4,468,816 A * 9/1984 Kaufer ..... 2/104
4,964,172 A * 10/1990 Bollard ..... 2/104
5,008,960 A * 4/1991 Hemming ..... 2/104
5,038,411 A * 8/1991 St. Armand ..... 2/104
5,440,762 A 8/1995 Schill
5,469,582 A * 11/1995 Livingston ..... 2/104
5,570,474 A * 11/1996 Berry et al. ..... 2/104
5,592,692 A * 1/1997 Larson ..... 2/104
5,652,960 A * 8/1997 Kaknevicius ..... 2/104
5,893,171 A 4/1999 Ries
6,216,273 B1 * 4/2001 Williams ..... 2/104
6,216,274 B1 * 4/2001 Harris ..... 2/104

* cited by examiner

*Primary Examiner*—Gloria M. Hale
(74) *Attorney, Agent, or Firm*—Snell & Wilmer L.L.C.; Michelle R. Whittington

(57) ABSTRACT

An improved garment for providing a privacy screen for the body is disclosed. The invention is particularly useful by a nursing mother in a breastfeeding setting. The garment lies over the shoulder of the wearer extending down the back to a weighting means and down the front to an expanded lower portion. The weighting means provides a counter-balance to adequately retain the position of the garment on the wearer. The expanded lower portion drapes over the midriff of the wearer to provide breathable privacy to the wearer and contents within.

18 Claims, 5 Drawing Sheets

NURSING GARMENT

FIELD OF INVENTION

The invention relates generally to an improved apparatus for providing a privacy screen for the body. The invention is particularly useful by a nursing mother in a breastfeeding setting.

BACKGROUND OF THE INVENTION

Many styles of nursing blankets, cover-ups, and drapes have been proposed to provide privacy to a nursing mother while breasffeeding; however, the prior art attempts at an improved nursing garment fall short of curing all the problems presently facing nursing mothers. For example, U.S. Pat. No. 5,008,960, which is herein incorporated by reference, discloses a nursing garment having an upper shoulder portion attached to a lower body portion. At the end of the shoulder portion, the cloth is folded over and sewn to itself to form a pocket. Inside the pocket there is a layer of padding surrounding a weight. The weight provides a counter-balance to the lower body portion, thus maintaining the garment in position over the mother's shoulder. The preferred embodiment discloses a metal weight, such as lead, stainless steel or the like.

While this previous invention was successful with nursing mothers nationwide, various drawbacks to this nursing garment became evident. For example, the metal weight is generally formed into a single bar and then wrapped with padding. Unless constructed carefully, after multiple uses and subsequent washings, the edges of the metal bar may wear through the padding and eventually through the cloth pocket covering. In addition, the anchoring (i.e. stitching) securing the padded weight to the garment can disengage, especially if poorly anchored, causing the bar to slip around inside the pocket. Moreover, the pocket (i.e., one continuous piece of cloth folded over on itself and stitched to define a completely enclosed pocket) may begin to separate at the stitched seam, thereby allowing the weight to escape.

Furthermore, at times, the prior art garment may not always cater to the comforts of the nursing mother. Ideally, the metal weight is sufficiently padded so that the edges of the bar are unnoticed by the mother while she is using the garment. However, if the bar begins to wear through the padding, or if the bar settles in a peculiar spot on the mother's back, she may be unable to comfortably lean back while nursing.

In recent years, mothers have continued to nurse the child until near-toddler age. This poses a problem for the nursing mother, who desires to maintain privacy at all times while nursing her newborn infant, as well as when the baby reaches walking age and beyond. As such, the dimensions of the previous garment may fail to provide the mother and child with the long-term coverage desired. For example, the lower portion may not be long enough to provide a privacy covering for older infants.

Additionally, the shoulder portion of the previous garment may not adequately maintain the balance between the weight and the lower portion, especially for older infants. For instance, when nursing an older infant, the child may tug on the garment causing the garment to slip down. Moreover, nursing mothers are of variable size, height and weight. The dimensions of the shoulder portion may not equally accommodate the garment's balance for a plus-sized mother as well as a petite-sized mother. In addition, the shoulder portion may droop over the shoulder of a petite-sized mother and interfere with her side body functions, e.g., full arm and shoulder movement.

In another attempt, U.S. Pat. No. 5,570,474 to Berry et al., which is herein incorporated by reference, discloses a semicircular nursing drape for lying over a shoulder and to cover a breast and baby. Distal weights are included in the lower portion of drape. Shoulder weights are placed near the mother's neck to help secure the drape in place, while all of the weights are in an exemplary embodiment, held in place with a sewn-in pocket. Berry also discloses a drape having two elongated members which lie over the shoulder of the mother. Each member includes a distal weight pocket preferably sewn to form a weight pocket border. The weight is distributed within the pocket and may be in the form of sand or polypropylene beads. This attempt at a nursing garment, however, has various drawbacks. For example, Berry discloses multiple locations in the drape for holding weights, such as, near the mother's neck, at the distal ends of the drape near the nursing infant, and at two distal ends over the mother's shoulder. Multiple weight locations can cause the drape to be awkward and heavy (e.g. Berry discloses up to 12 ounces). Moreover, Berry discloses an undesirable weight pocket design whereby the weight pocket border is susceptible to opening and releasing the weight. In addition, the drape may not adequately cover an older infant. The drape covers the mother's shoulder to protect the mother's clothing from becoming soiled while burping the infant; however, this may be cumbersome for the mother to freely move her arm and shoulder.

In yet another attempt, U.S. Pat. No. 5,893,171 to Ries, which is herein incorporated by reference, discloses a nursing cover-up that clips to the front of the mother's clothing. Alternatively, the mother may attach the cover-up around her neck with a supplied strap. The nursing cover-up includes a flexible coated wire sewn into the upper edge of the cover-up to permit the mother to view the child. A covered slit opening in the front of the cover-up allows the mother to access underneath the cover-up as needed. While Ries provides a less restrictive approach for the mother's arm movements, the features of the cover-up, such as clipping and manipulating wire, may be undesirable and bulky.

SUMMARY OF THE INVENTION

The present invention addresses the problems outlined above and provides a nursing garment having a shoulder portion attached to an expanded lower portion. The shoulder portion having an elongated section and a distal end, wherein the elongated section is configured to drape over a shoulder of a nursing mother. The distal end includes a distributed weighting means. In an exemplary embodiment of the invention, the nursing garment further includes an absorbent accessory. The accessory is suitably configured to join to the shoulder portion of the garment to protect the garment and mother from being soiled, as for example, while burping the child.

BRIEF DESCRIPTION OF THE DRAWINGS

These and other features, aspects and advantages of the present invention will become better understood with reference to the following description, appending claims, and accompanying drawings wherein, like numerals represent like elements, and:

DETAILED DESCRIPTION OF EXEMPLARY EMBODIMENTS

The invention relates to an improved apparatus for providing a privacy screen for the body. The invention is particularly useful as a nursing garment for use by a nursing mother in a breastfeeding setting. While conveniently described in the context of a nursing garment, it should be readily recognized that the invention may be useful in a variety of applications including, but not limited to, when privacy is desired to shield the public's view, and particularly, to shield the public's view from the midriff section of the wearer.

Figure 1:
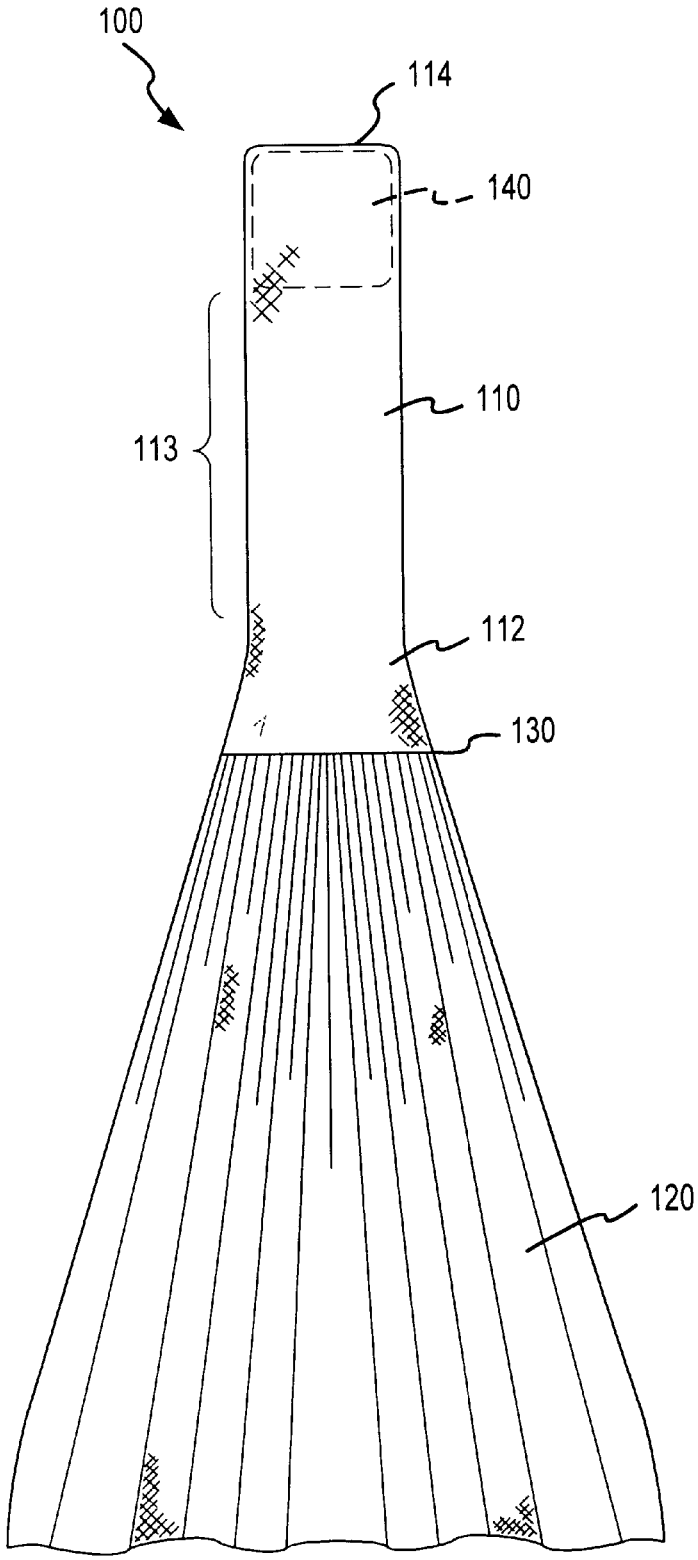
FIG. 1 illustrates a frontal view of nursing garment in accordance with an exemplary embodiment of the present invention.

FIG. 1 illustrates a garment 100 useful in providing a privacy screen for the body. Garment 100 may be particularly useful as a nursing garment (screen) for a nursing mother. Garment 100 includes a shoulder portion 110 having a proximal end 112 and a distal end 114, which define an elongated mid section 113, an expanded lower portion 120, an attachment point 130, and a weighting means 140. Garment 100 may include any suitable washable fabric, such as, but not limited to, cotton cloth, yarn, and cotton-knit. In an exemplary embodiment, the fabric allows air to freely pass (i.e., breathable), thereby maintaining ventilation between the body and the garment. As a nursing garment, air circulation in the area between the mother's body and the inside of the garment provides fresh air to the nursing baby. Maintaining the comfort of both the baby and the mother facilitates and furthers the nursing process. It should be appreciated that while air passage helps maintain the free-flow of air surrounding the baby, the airlets in the fabric should remain small enough to provide adequate privacy.

In accordance with an exemplary embodiment of the invention, the fabric includes a fine yarn knitted in, for example, a butterfly stitch pattern. The garment may be patterned such that it is textured on one side and smooth or waffle texured on the other side. The textured side is aesthetically pleasing while the smooth side provides a soft surface against the child. One aspect of the present embodiment is that lightweight yarn does not lie heavily against the child or mother. Rather, the fabric seems to float atop the child providing the desired privacy without weighting or discomforting the mother and child.

Lower portion or skirt 120 is gathered and attached at a top part, then attached to proximal end 112 of shoulder portion 110 to form attachment point 130. Skirt 120 is essentially gathered because the skirt is longer and wider then shoulder portion 110. In an exemplary embodiment, skirt 120 is sized to provide privacy for a mother and her newborn child, as well as her near-toddler aged child. For example, in an exemplary embodiment, the garment may adequately cover the mother's breast and child, while draping over her knees and thighs.

Attachment point 130 is formed by joining skirt 120 to shoulder portion 110 by, for example, stitching, adhesive materials, mechanical attachment devices or the like. In an exemplary embodiment, the fabric closely surrounding the attachment point 130 is substantially smooth and designed to have a denser look. This provides a soft, textured-free area that can rest atop the child's head. In addition, this area may provide more privacy for the mother to conceal her breast.

Shoulder portion or extension 110 may be made from the same or similar material as lower portion 120. Shoulder portion 110 is suitably sized to provide an adequate balance between the weight of lower portion 120 and weighting means 140. In an exemplary embodiment, shoulder portion 110 is in the range of about 16 to 20 inches in length, i.e., measured from proximal end 112 at attachment point 130 to distal end 114, and, in an exemplary embodiment, in the range of about 17 to 18 inches. As just mentioned, it is advantageous to size the shoulder portion 110 such that a positioned balance is maintained over the wearer's shoulder, even at times when the child grasps the garment. In addition, shoulder portion 110 is sized to provide a comfortable fit for the wearer. For example, shoulder portion 110 is of suitable length to settle distal end 114 in a comfortable location on the wearer's back (e.g., to allow the wearer to comfortably lean back). Mid section 113 is narrowly sized to fit adjacent the wearer's neck to the tip of the shoulder, thus avoiding interference during side body functions, such as arm and shoulder movements.

Weighting means 140 is secured to distal end 114 of shoulder portion 110. Weighting means 140 provides a counter-balance for the remaining garment, in particular for lower portion 120. As previously mentioned, garment 100 is, in an exemplary embodiment, constructed from a light-weight fabric, thereby reducing the amount of weight needed to counter-balance the garment on the wearer's shoulder and providing an overall lightweight garment. In an exemplary embodiment, weighting means 140 is in the range of about 2 to 3 ounces. Weighting means 140 may be a distributed weight, e.g., the weight is not concentrated in a single area. Distributed weights are typically moveable and distribute or spread the combined weight over a larger area. Weighting means 140 may further include a conforming weight to meet the movement needs of the wearer. As the wearer repositions her body or leans back against the weight, the weight is able to temporarily conform to the curvatures of the wearer's back. Thus, providing a more comfortable garment for the wearer.

In an exemplary embodiment, weighting means 140 includes a plurality of small articles, such as beads, beans, or pellets. This aspect of the present embodiment provides both a distributed weight and a conforming weight. For example, plastic pellets, such as polypropylene, provide adequate weight, size and shape. The small articles may be placed inside a bag or pouch. The bag should be properly sealed to prevent escape of the contents. In addition, the bag may be made from a soft, washable fabric, such as tricot knit.

In yet another embodiment, a padding (not shown) is suitably placed near weighting means 140 to enhance the comfort of the wearer. For example, weighting means 140 may be encased in padding, such as fiberfill, batting and the like. In one aspect of the present embodiment, weighting means 140 is a bag containing small articles and padding and is suitably secured to the bag by, for example, stitching, adhesives or other securing methods. It should be appreciated that various other types and styles of weights may be equally as effective, e.g., a conforming gel-like material. However, it should be appreciated that, in an exemplary embodiment, the weight will withstand multiple launders.

Figure 2:
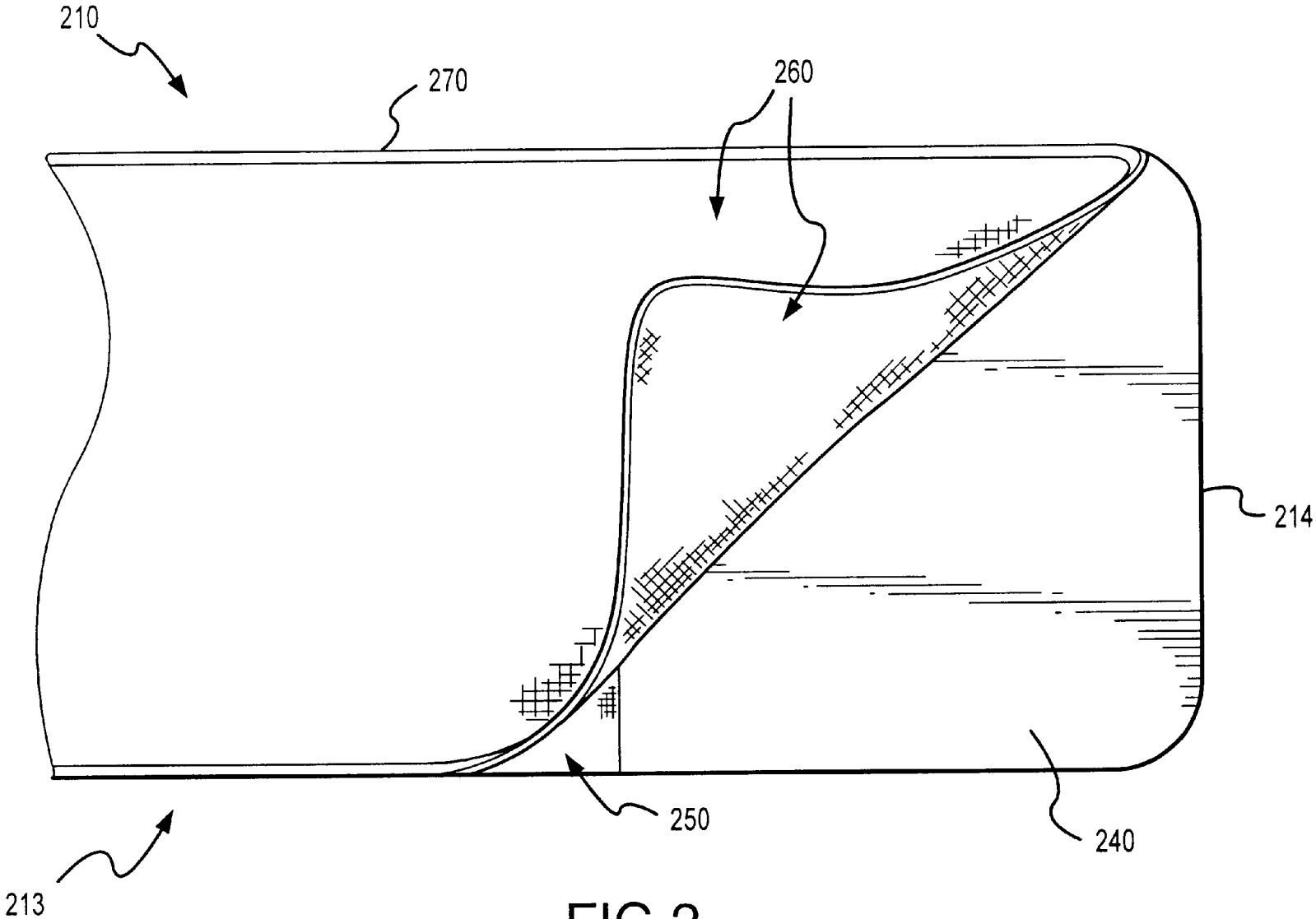
FIG. 2 illustrates placement of a distributed weighting means in accordance with an exemplary embodiment of the present invention.

FIG. 2 illustrates a shoulder portion 210 having a mid section 213 and a distal end 214 in accordance with an exemplary embodiment of the invention. In particular, FIG. 2 illustrates placement of weighting means 240 in distal end 214. One aspect of the embodiment is the dual fabric layer configuration, such that a layer 250 and a layer 260 of suitable fabric are bonded together at an outermost edge 270. In the present embodiment, weighting means 240 may be placed at the most distal end 214 of shoulder portion 210, and bonded between layers 250 and 260 at the outermost edge 270, simultaneously. Alternatively, weighting means 240 may be first bonded to one of the layers and then layers 250 and 260 may be bonded together.

With continued referenced to FIG. 2, in an exemplary embodiment, weighting means 240 may be shaped such that three sides are suitably bound to shoulder portion 210. For example, outermost edge 270 runs along three sides of weighting means 240 and therefore, bonding along edge 270 adequately retains weighting means 240 in place. A fourth side of weighting means 240, e.g., as shown in FIG. 2, the side closest to mid section 213, would remain free, thus providing a non-constricting area for the weight to move around as needed (e.g., to conform to the wearer's back). Outermost edge 270 is suitably bonded. Various methods of bonding, e.g., stitching, knitting, adhesive, mechanical fasteners, are contemplated and considered to be within the scope of the invention. One such method includes knitting which can be accomplished by hand or by a knitting machine. As described herein, shoulder portion 210, in an exemplary embodiment, includes a dual layered configuration. However, it should be appreciated that various single or multiple layered configurations may fall within the scope of the invention.

Figure 3A:
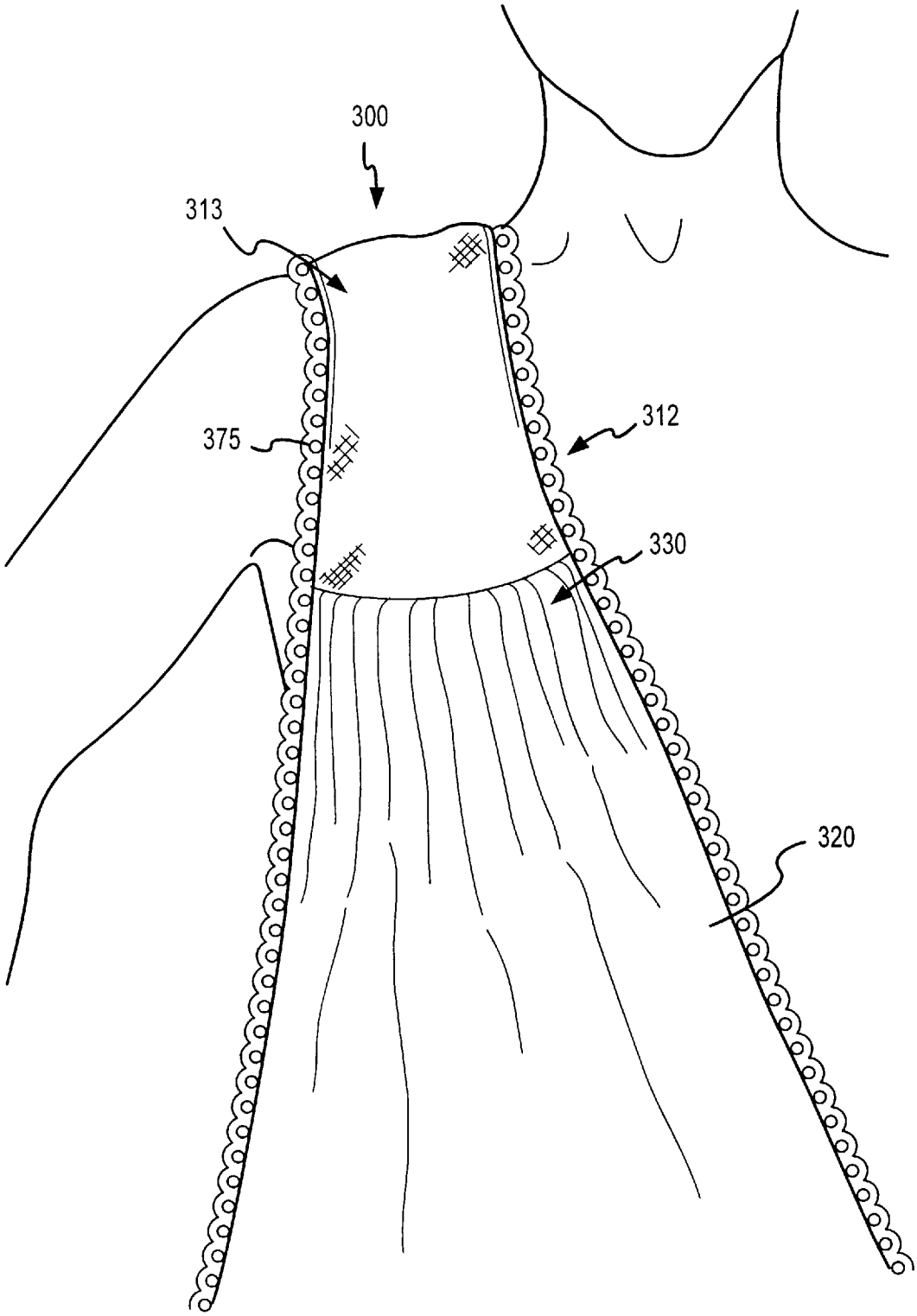
FIGS. 3A and 3B illustrate front and back views, respectively, of a nursing garment while in use in accordance with an exemplary embodiment of the present invention.
Figure 3B:
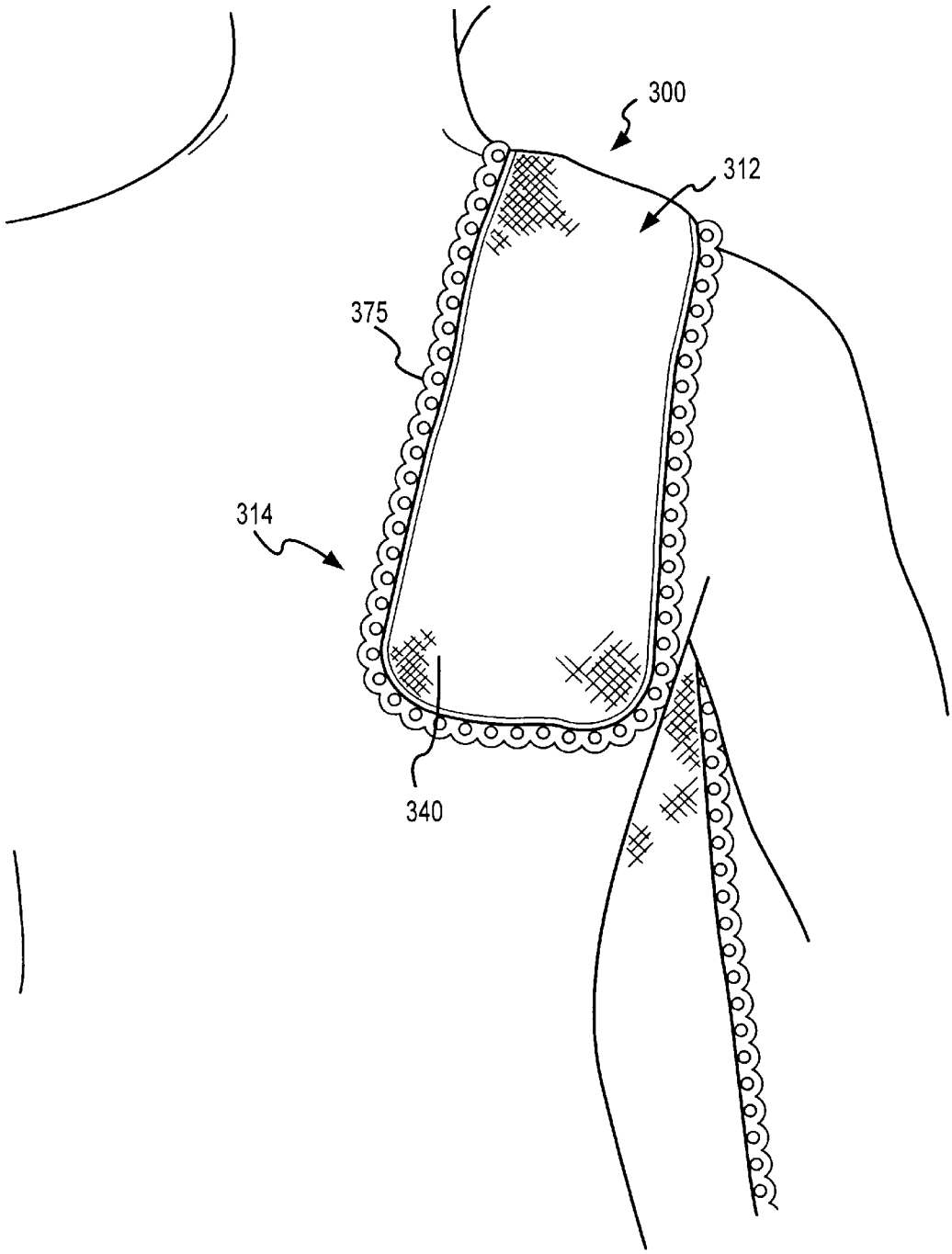

FIGS. 3A and 3B illustrate a garment 300 in use. The wearer. e.g., a nursing mother, places mid section 313 over the shoulder such that distal end 314 lies on the back, and lower portion 320 drapes over the midriff. Weighting means 340 should comfortably settle down the back, (typically over a shoulder blade) and not interfere with the wearer's side body movements. On the other hand, as the wearer moves around, or lies back, weighting means 140 conforms to meet the comforts of the wearer.

With continued referenced to FIGS. 3A and 3B, garment 300 may be adorned with various decorative items. For example, a trim 375 may be attached to the entire garment. Trim 375 may include lace, velvet, ribbon or the like. It should be recognized that FIGS. 3A and 3*b* merely illustrate an exemplary garment and wearer. Thus, the actual positioning of the garment may vary from wearer to wearer. For example, the wearer's comfort, height, weight, and shape may dictate the wearer's preference for placement of the entire garment.

FIGS. 4A–5B illustrate exemplary absorbent accessories 480 and 580 to use in combination with a garment of the invention. Absorbent accessories 480 and 580 protect the garment and wearer's clothing from being soiled (e.g., while burping a child). In general, absorbent accessories 480 and 580 are placed in proximity to the mid section of the shoulder portion. For example, should the occasion necessitate burping a child, the wearer may place the child near the wearer's shoulder, atop the absorbent accessory, and be confident that the underlying garment and clothing can remain soil-free during the process. Absorbent accessories 480 and 580 may be made from any suitable absorbent, washable material, such as terry cloth, cotton-blends, and the like. Additionally, the absorbent accessories may include a moisture barrier on the interior surface (i.e., the surface in contact with the garment) to substantially prevent moisture from reaching the garment. In an exemplary embodiment, the absorbent accessories are configured for easy addition and removal to the garment, for example, to facilitate replacement after use. In addition, absorbent accessories may be added and removed without having to completely remove the garment once in place on the wearer.

Figure 4A:
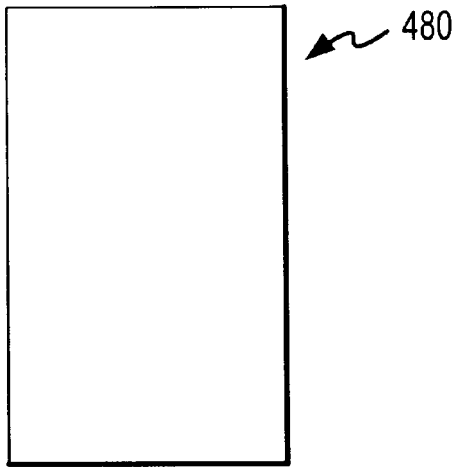
FIGS. 4A–5B illustrate various embodiments of an absorbent accessory in accordance with the present invention.
Figure 4B:
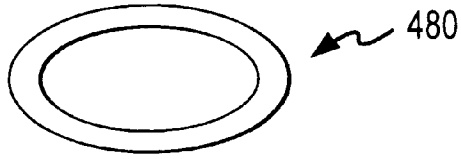

With direct reference now to FIGS. 4A and 4B, one exemplary absorbent accessory 480 is illustrated. Absorbent accessory 480 includes a tube-shaped piece of suitable fabric that is configured to fit over the shoulder portion of the garment. In other words, accessory 480 is slipped over the shoulder portion and positioned as desired.

Figure 5A:
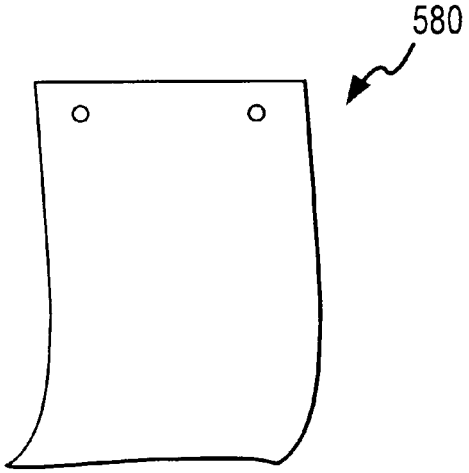
Figure 5B:
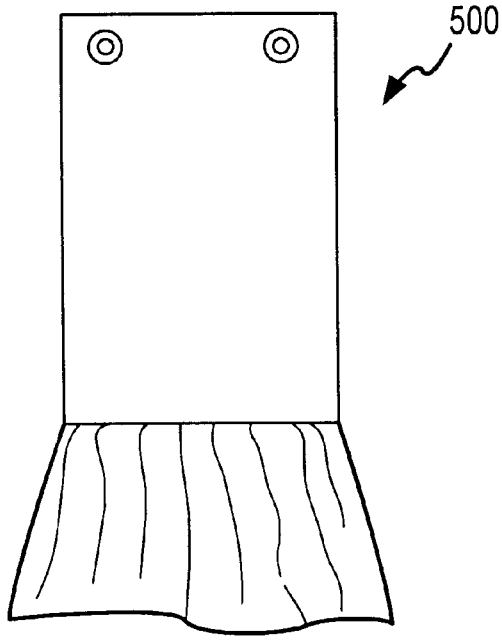

Referring now to FIGS. 5A and 5B, another exemplary absorbent accessory 580 is illustrated. Accessory 580 may include a substantially planar piece of fabric that is suitably attached to garment 500. For example, accessory 580 may include one or more fasteners configured to mate with a matching fastener on garment 500. Alternatively, the absorbent accessory may include a clip, velcro, snap, zipper, and/or similar mechanical fastener that may or may not include a matching fastener on the garment.

The present invention has been described above with reference to exemplary embodiments. However, those skilled in the art having read this disclosure will recognize that changes and modifications may be made to the embodiments without departing from the scope of the present invention. For example, the dimensions of the garment may be modified to fit the needs of the wearer, various fabrics in a variety of designs and patterns are suitable, and various types, shapes, and designs of absorbent accessories may be used in a similar manner as herein described. These and other changes or modifications are intended to be included within the scope of the present invention, as expressed in the following claims.

What is claimed is:

1. A nursing garment comprising:

(a) an expanded lower portion;

(b) a single shoulder portion attached to the lower portion, the shoulder portion having an elongated section and a distal end, the elongated section configured to drape over a shoulder of a nursing mother; and (c) a distributed weighting means secured to the distal end of the shoulder portion.

2. The nursing garment of claim 1, wherein the weighting means comprises at least one of pellets, beans and beads.

3. The nursing garment of claim 1, wherein the weighting means comprises polypropylene pellets.

4. The nursing garment of claim 3, wherein the polypropylene pellets are confined in a bag and the bag is secured to the distal end.

5. The nursing garment of claim 1, wherein the shoulder portion comprises two substantially similar layers bonded at an outermost edge of the layers.

6. The nursing garment of claim 5, wherein the weighting means is secured between the two layers at the outermost edge.

7. A nursing garment comprising:

(a) an expanded lower portion;

(b) a single shoulder portion attached to the lower portion, the shoulder portion having an elongated section and a distal end, the elongated section configured to drape over a shoulder of a nursing mother;

(c) a distributed weighting means secured to the distal end of the shoulder portion; and (d) an absorbent accessory configured to removably adhere to the shoulder portion.

8. The nursing garment of claim 7, wherein the absorbent accessory comprises a tubular shape configured to slip over the top of the shoulder portion.

9. The nursing garment of claim 1, wherein the shoulder portion configured to narrowly fit atop the shoulder of the nursing mother.

10. The nursing garment of claim 1 comprising a fabric configured to allow air to pass through.

11. The nursing garment of claim 10, wherein the shoulder portion and the lower portion meet at an attachment point and an area in close proximity to the attachment point comprises a densely configured design of the fabric.

12. The nursing garment of claim 4, wherein the bag is surrounded with padding.

13. A nursing garment to cover the mid-section of a nursing mother, comprising:

(a) an upper section comprising two continuous layers, the layers secured together at all points of an outermost edge, the upper section having a proximal end and a distal end defining a mid section, the mid section configured to drape over the shoulder of a nursing mother;

(b) a lower section attached to the proximal end of the upper section, the lower section configured to breathably cover the mid section of a nursing mother and child; and (c) a conforming weight disposed between the two layers of the distal end of the upper portion.

14. The nursing garment of claim 13, wherein the weight comprises a distributed weight.

15. The nursing garment of claim 13, wherein the weight comprises a bag of polypropylene pellets.

16. The nursing garment of claim 13, further comprising an absorbent accessory configured to removably adhere to the upper section.

17. A privacy screen for the body comprising:

(a) a narrow shoulder section having a length in the range of 16 to 20 inches, the shoulder section having a distal end and a proximal end, the distal end hanging down a back of the body and the proximal end extending down a front of the body;

(b) a midriff section expanding to provide privacy to a midriff of the body;

(c) an attachment point joining the shoulder section to the midriff section; and (d) a body conforming weight in the range of 2 to 3 ounces attached within the distal end of the shoulder section.

18. A method of manufacturing a nursing garment comprising:

(a) forming a narrow shoulder section from two substantially similar elongated pieces of washable fabric and bonding the pieces at an outermost edge;

(b) disposing and securing a conforming weighting means at a distal end of the shoulder section;

(c) forming a midriff section such that when the garment is in use, substantially all the midriff area of the user is covered; and (d) attaching the shoulder section to the midriff section.

* * * * *